US009224327B2

(12) United States Patent
Hyeon et al.

(10) Patent No.: US 9,224,327 B2
(45) Date of Patent: Dec. 29, 2015

(54) POWER SUPPLY DEVICE, DISPLAY APPARATUS HAVING THE SAME, AND POWER SUPPLY METHOD

(75) Inventors: Byeong-cheol Hyeon, Suwon-si (KR); Kang-hyun Yi, Yesan-gun (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 213 days.

(21) Appl. No.: 13/616,003

(22) Filed: Sep. 14, 2012

(65) Prior Publication Data

US 2013/0169695 A1 Jul. 4, 2013

(30) Foreign Application Priority Data

Dec. 28, 2011 (KR) ..... 10-2011-0144994

(51) Int. Cl.
*G09G 3/32* (2006.01)

(52) U.S. Cl.
CPC ..... *G09G 3/3208* (2013.01); *G09G 2320/0223* (2013.01); *G09G 2320/0242* (2013.01); *G09G 2320/0666* (2013.01); *G09G 2330/02* (2013.01); *G09G 2330/021* (2013.01); *G09G 2330/028* (2013.01); *G09G 2360/16* (2013.01)

(58) Field of Classification Search
CPC . G09G 3/3258; G09G 3/3233; G09G 3/3225; G09G 2330/028
USPC ..... 345/76, 77, 83, 211, 212
See application file for complete search history.

(56) References Cited

U.S. PATENT DOCUMENTS

| | | | | |
|---|---|---|---|---|
| 6,747,617 | B1 * | 6/2004 | Kawashima | 345/77 |
| 7,495,397 | B2 * | 2/2009 | Okabe | 345/82 |
| 7,663,598 | B2 * | 2/2010 | Kim | 345/82 |
| 2002/0070914 | A1 | 6/2002 | Bruning et al. | |
| 2006/0007212 | A1 * | 1/2006 | Kimura et al. | 345/204 |
| 2006/0066525 | A1 * | 3/2006 | Childs | 345/76 |
| 2008/0224629 | A1 | 9/2008 | Melanson | |
| 2010/0277513 | A1 * | 11/2010 | Byun | 345/77 |
| 2011/0084992 | A1 | 4/2011 | Ishizuka | |
| 2012/0280637 | A1 * | 11/2012 | Tikkanen et al. | 315/294 |
| 2014/0320555 | A1 * | 10/2014 | Hekmatshoartabari et al. | 345/691 |

OTHER PUBLICATIONS

Communication dated Jun. 13, 2013 issued by the European Patent Office in corresponding Application No. 12188203.9.
Communication dated Nov. 27, 2014 issued by the European Patent Office in counterpart European Patent Application No. 12 188 203.9.

* cited by examiner

*Primary Examiner* — Kumar Patel
*Assistant Examiner* — Sejoon Ahn
(74) *Attorney, Agent, or Firm* — Sughrue Mion, PLLC

(57) ABSTRACT

A display apparatus includes an OLED panel receiving an input of a video signal and a plurality of driving power levels for RGB colors and displaying an image, a video signal providing unit providing the video signal to the OLED panel, and a power supply supplying the plurality of driving power levels to the OLED panel unit and performing individual feedback control for each of the plurality of driving power levels.

19 Claims, 8 Drawing Sheets

POWER SUPPLY DEVICE, DISPLAY APPARATUS HAVING THE SAME, AND POWER SUPPLY METHOD

CROSS-REFERENCE TO RELATED APPLICATION

This application claims priority from Korean Patent Application No. 10-2011-0144994, filed on Dec. 28, 2011, in the Korean Intellectual Property Office, the disclosure of which is incorporated herein by reference in its entirety.

BACKGROUND

1. Field

Apparatuses and methods consistent with exemplary embodiments relate to a power supply device, a display apparatus having the same, and a power supply method, and more particularly to a power supply device, a display apparatus having the same, and a power supply method, which can supply a plurality of driving power levels for RGB colors to an Organic Light Emitting Diode (OLED) panel and perform feedback control for the plurality of driving powers.

2. Description of the Related Art

A display apparatus processes and displays digital or analog video signals received from outside or various video signals stored in an internal storage device in the form of compression files of various formats.

Recently, OLED display apparatuses have been actively developed. The OLED display apparatus is a type of flat-panel display, and uses organic light-emitting diodes. The organic light-emitting diode is a self-luminous organic material that emits light by itself using an electroluminescence phenomenon in which fluorescent organic compounds emit light in response to current flow thereto. The OLED display apparatus is made as a thin type display apparatus, and has a wide viewing angle and a quick response speed. Further, the OLED display apparatus has advantageous price competitiveness due to better picture quality than the LCD in a small-size screen and a simple manufacturing process.

However, the OLED display apparatus in the related art has unnecessary power consumption because it is driven using only single driving power level. Specifically, although the sizes of the driving voltage levels required for RGB color channels are different from one another, the OLED display apparatus in the related art receives and uses only one driving power level regardless of the channels, and thus it causes unnecessary power consumption in the channels that do not require high driving voltage.

SUMMARY

Exemplary embodiments may address at least the above problems and/or disadvantages and other disadvantages not described above.

Accordingly, one or more exemplary embodiments may provide a power supply device, a display apparatus having the same, and a power supply method, which can perform feed-forward control with respect to driving powers that are supplied to an OLED panel based on a video signal provided to the OLED panel.

According to an aspect of an exemplary embodiment, a display apparatus includes an OLED panel unit receiving an input of a video signal and a plurality of driving powers for RGB colors and displaying an image; a video signal providing unit providing the video signal to the OLED panel unit; and a power supply unit supplying the plurality of driving powers to the OLED panel unit and performing individual feedback control for each of the plurality of driving powers.

The OLED panel unit may include a plurality of pixels arranged that are classified into a plurality of pixel groups for the RGB colors and arranged in a matrix form, and the plurality of pixel groups receive separate driving powers, respectively.

The power supply unit may include a rectifying unit rectifying an external AC power; a power factor correction (PFC) unit making a voltage and current of the rectified AC power in the same phase and transforming the AC voltage into a DC voltage; a converter converting the DC voltage into a plurality of voltages to output the plurality of voltages through a multi-winding insulation transformer; a plurality of output units outputting the plurality of driving voltages; a plurality of switching units selectively providing the plurality of voltages of the converter to the plurality of output units; and a power control unit controlling the plurality of switching units to perform the feedback control with respect to the plurality of driving voltages output from the output unit.

Each of the plurality of switching units may include a switching element having one end connected to the converter; an inductor having one end connected to the other end of the switching element and the other end connected to one of the plurality of output units; and a diode having an anode commonly connected to the other end of the switching element and one end of the inductor and a cathode grounded.

The converter is a discrete LLC converter.

The power supply unit may perform the feed-forward control with respect to the plurality of driving powers based on the video signal.

The power supply unit may predict driving current for the RGB colors to be supplied to the OLED panel unit based on luminance information of the video signal and perform the feed-forward control with respect to the plurality of driving powers based on the predicted driving current.

The luminance information includes information on light emitting levels for the RGB colors of the OLED panel unit and timing information to which the light emitting levels are applied.

According to another aspect of an exemplary embodiment, a power supply device providing a plurality of driving powers for RGB colors to an OLED includes a rectifying unit rectifying an external AC power; a PFC unit making a voltage and current of the rectified AC power in the same phase and transforming the AC voltage into a DC voltage; a converter converting the DC voltage into a plurality of voltages to output the plurality of voltages through a multi-winding insulation transformer; a plurality of output units outputting the plurality of driving voltages; a plurality of switching units selectively providing the plurality of voltages of the converter to the plurality of output units; and a power control unit controlling the plurality of switching units to perform the feedback control with respect to the plurality of driving voltages output from the output unit.

Each of the plurality of switching units may include a switching element having one end connected to the converter; an inductor having one end connected to the other end of the switching element and the other end connected to one of the plurality of output units; and a diode having an anode commonly connected to the other end of the switching element and one end of the inductor and a cathode grounded.

The converter is a discrete LLC converter.

The power supply unit may perform the feed-forward control with respect to the plurality of driving powers based on the video signal.

The power supply unit may predict driving current for the RGB colors to be supplied to the OLED panel unit based on luminance information of the video signal and perform the feed-forward control with respect to the plurality of driving powers based on the predicted driving current.

The luminance information includes information on light emitting levels for the RGB colors of the OLED panel unit and timing information to which the light emitting levels are applied.

According to another aspect of an exemplary embodiment, a power supply method of a power supply device providing a plurality of driving powers for RGB colors to an OLED includes rectifying an external AC power; making a voltage and current of the rectified AC power in the same phase; transforming the AC power of which the voltage and current have been made in the same phase into a DC voltage of a preset level; converting the DC voltage of the preset level into the plurality of driving powers for the RGB colors; outputting the plurality of converted driving powers to the OLED panel; and performing a feedback control with respect the plurality of converted driving powers.

The converting step may convert the DC voltage into the plurality of driving powers having different voltage levels for the RGB colors.

The power supply method according to an aspect of an exemplary embodiment may further include performing the feed-forward control with respect to the plurality of driving powers based on the video signal.

The step of performing the feed-forward control may predict driving current for the RGB colors to be supplied to the OLED panel unit based on luminance information of the video signal and perform the feed-forward control with respect to the plurality of driving powers based on the predicted driving current.

The luminance information includes information on light emitting levels for the RGB colors of the OLED panel unit and timing information to which the light emitting levels are applied.

BRIEF DESCRIPTION OF THE DRAWINGS

The above and/or other aspects, features and advantages of the present disclosure will become more apparent by describing certain exemplary embodiments, with reference to the accompanying drawings, in which.

DETAILED DESCRIPTION OF EXEMPLARY EMBODIMENTS

Figure 1:
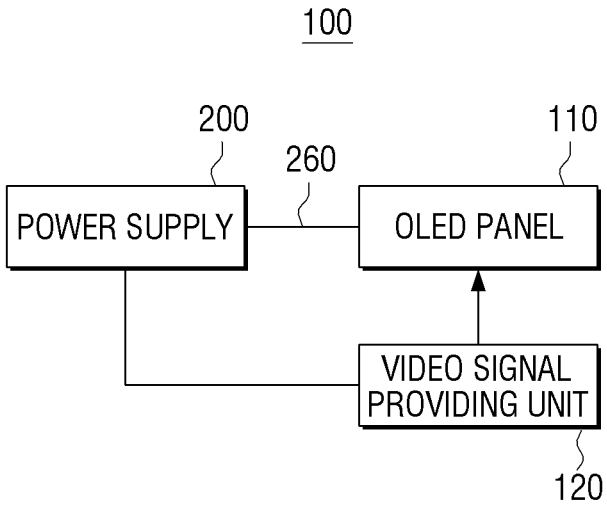
FIG. 1 is a block diagram illustrating a display apparatus according to an exemplary embodiment.

Hereinafter, certain exemplary embodiments are described in greater detail below with reference to the accompanying drawings.

In the following description, like drawing reference numerals are used for the like elements, even in different drawings. The matters defined in the description, such as detailed construction and elements, are provided to assist in a comprehensive understanding of exemplary embodiments. However, exemplary embodiments can be carried out without those specifically defined matters. Also, well-known functions or constructions are not described in detail since that would obscure the invention with unnecessary detail.

FIG. 1 is a block diagram illustrating a configuration of a display apparatus according to an exemplary embodiment.

Referring to FIG. 1, a display apparatus 100 according to an exemplary embodiment may include an OLED panel 110, a video signal providing unit 120, and a power supply 200.

The OLED panel 110 receives a video signal and a plurality of driving powers for RGB colors, and displays an image. Specifically, the OLED panel 110 may display the image corresponding to the video signal provided from the video signal providing unit 120 to be described later and the plurality of driving powers supplied from the power supply 200. For this, the OLED panel 110 may be provided with a plurality of pixels that include organic light emitting diodes. The detailed configuration of the OLED panel 110 will be described later with reference to FIG. 7.

The video signal providing unit 120 provides the video signal to the OLED panel 110. Specifically, the video signal providing unit 120 supplies video data and/or various video signals for displaying the video data to the OLED panel 110. Here, the video signal has a light emitting period for transferring information on light emitting levels and an addressing period for transferring address information to which the light emitting period is applied, and one frame period has one light emitting period and one addressing period.

The power supply 200 supplies the plurality of driving powers to the OLED panel 110, and performs individual feedback control for each of the plurality of driving powers. Here, the feedback control means a control that compares a control amount with a target value and performs a correction operation to match them. Accordingly, the power supply 200 may perform the feedback control with respect to the plurality of driving powers using preset driving voltage values for the RGB colors as target values and the plurality of output driving voltage values as the control amounts. The detailed configuration and operation of the power supply 200 will be described later with reference to FIGS. 3 to 5.

A plurality of output lines 260 may provide the plurality of driving power levels including different voltage values and/or different current values from the power supply 200 to the OLED panel 110. The plurality of output lines 260 may be configured by one cable or a plurality of cables.

Hereinafter, the detailed configuration of the display apparatus 100 will be described with reference to FIG. 2.

Figure 2:
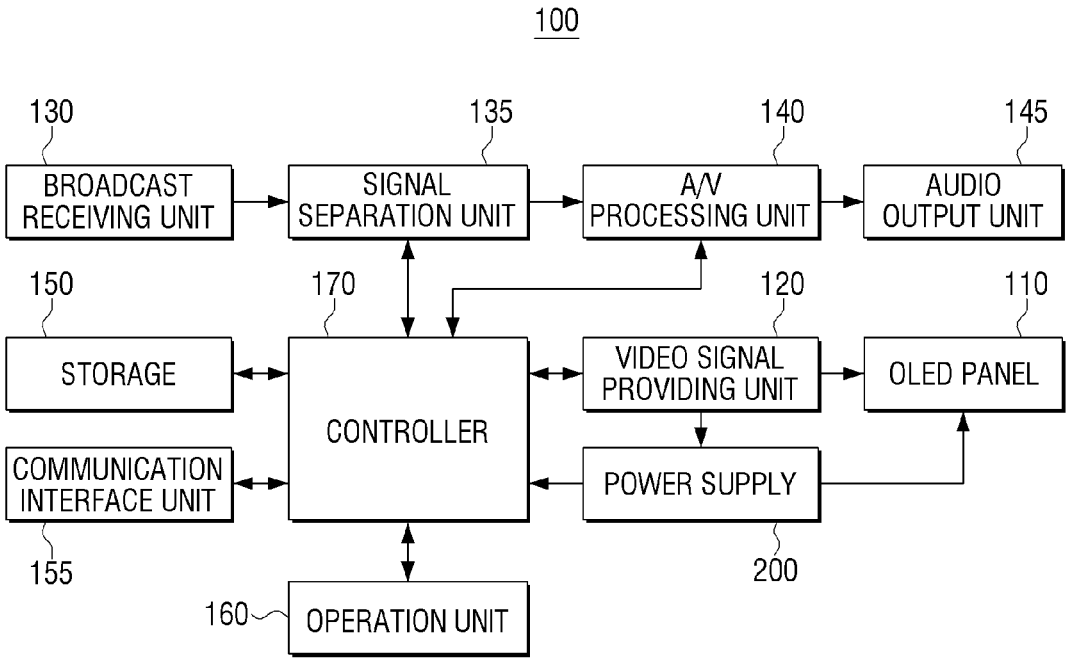
FIG. 2 is a block diagram illustrating the detailed configuration of a display apparatus according to an exemplary embodiment.

FIG. 2 is a block diagram illustrating the detailed configuration of a display apparatus according to an exemplary embodiment.

Referring to FIG. 2, the display apparatus 100 according to an exemplary embodiment includes an OLED panel 110, a video signal providing unit 120, a broadcast receiving unit 130, a signal separation unit 135, an audio/video (A/V) processing unit 140, an audio output unit 145, a storage 150, a communication interface unit 155, an operation unit 160, a controller 170, and a power supply 200.

Since the operations of the OLED panel 110 and the power supply 200 are substantially the same as those described above, the duplicate description thereof will be omitted. In the illustrated example, the power supply 200 supplies the power only to the OLED panel 110 and the controller 170. However, the power supply 200 can provide the power to all of the elements that require the power in the display apparatus 100.

The broadcast receiving unit 130 receives a broadcasting signal by wire or wirelessly from a broadcasting station or a satellite, and demodulates the received broadcasting signal.

The signal separation unit 135 separates the broadcasting signal into a video signal, an audio signal, and an additional information signal. Then, the signal separation unit 135 transmits the video signal and the audio signal to the A/V processing unit 140.

The A/V processing unit 140 performs signal processing, such as video decoding, video scaling, audio decoding, and the like, with respect to the video signal and the audio signal input received from the broadcast receiving unit 130 and/or the storage 150. Then, the A/V processing unit 140 outputs the video signal to the video signal providing unit 120, and outputs the audio signal to the audio output unit 145.

In the case of storing the received video and audio signals in the storage 150, the A/V processing unit 140 may output the video and audio signals in a compressed form to the storage 150.

The audio output unit 145 converts the audio signal output from the A/V processing unit 140 into sound to output the sound to a speaker (not illustrated) or outputs the audio signal to an external device connected through an external output terminal (not illustrated).

The video signal providing unit 120 generates a Graphic User Interface (GUI) to be provided to a user. Then, the video signal providing unit 120 adds the generated GUI to an image output from the A/V processing unit 140. The video signal providing unit 120 also provides a video signal that corresponds to the image to which the GUI has been added to the OLED panel 110. Accordingly, the OLED panel 110 displays various kinds of information provided by the display apparatus 100 and the image transferred from the video signal providing unit 120.

Further, the storage 150 may store video content. Specifically, the storage 150 may receive the video content in which video and audio signals have been compressed from the A/V processing unit 140 to store the video content, and may output the stored video content to the A/V processing unit 140 under the control of the controller 170. The storage 150 may be implemented by a hard disk, a nonvolatile memory, a volatile memory, and the like.

The operation unit 160 is implemented by a touch screen, a touchpad, key buttons, a keypad, and the like, and provides the user operation of the display apparatus 100. In this exemplary embodiment, it is exemplified that a control command is input through the operation unit 160 provided on the display apparatus 100. However, the operation unit 160 may receive an input of the user operation from an external control device (for example, remote controller).

The communication interface unit 155 is formed to connect the display apparatus 100 to an external device (not illustrated), and may be connected to the external device through a Local Area Network (LAN), the Internet, or a Universal Serial Bus (USB) port.

The controller 170 controls the overall operation of the display apparatus 100. Specifically, the controller 170 may control the video signal providing unit 120 and the OLED panel 110 so that an image is displayed according to the control command input through the operation unit 160.

As described above, the display apparatus according to this exemplary embodiment supplies separate driving powers for RGB colors to the OLED panel, performs separate feedback controls with respect to the respective driving powers, and provides adaptive driving powers to the OLED panel. Accordingly, the power consumption of the display apparatus 100 can be reduced.

Although it is exemplified that the above-described functions are applied to the display apparatus that receives and displays the broadcast, the power supply device of an exemplary embodiment may be applied to any electronic device having the OLED panel.

Although it is exemplified that the power supply 200 is included in the display apparatus 100 as described above, the function of the power supply 200 may be implemented by a separate device. Hereinafter, a separate power supply device that performs the same function as the power supply 200 will be described with reference to FIG. 3.

Figure 3:
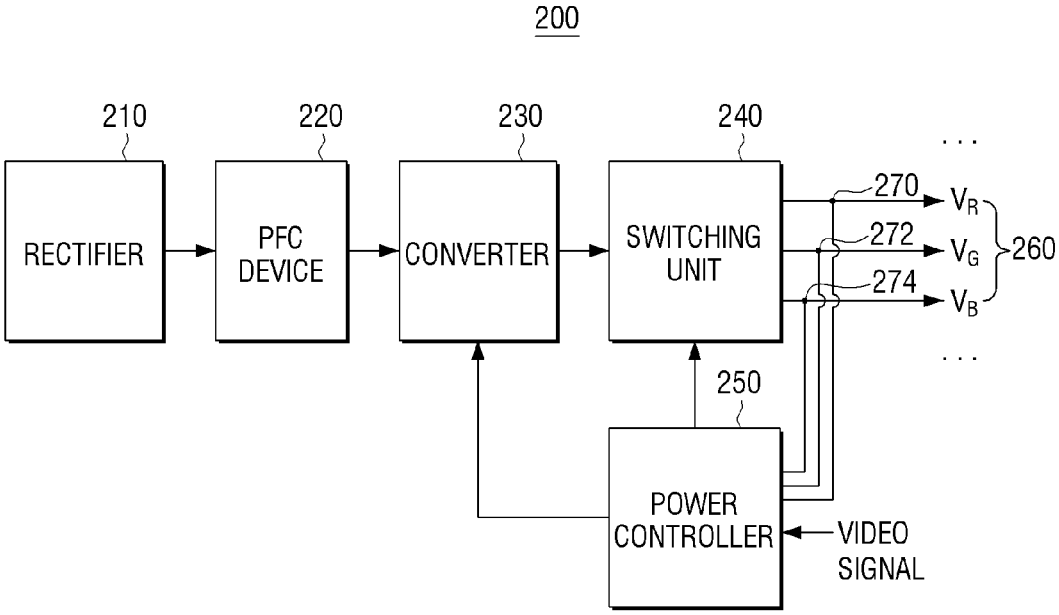
FIG. 3 is a block diagram illustrating the detailed configuration of a power supply device according to an exemplary embodiment.

FIG. 3 is a block diagram illustrating the detailed configuration of a power supply device according to an exemplary embodiment.

Referring to FIG. 3, the power supply 200 may include a rectifier 210, a PFC device 220, a converter 230, a switching unit 240, and a power controller 250.

The rectifier 210 rectifies an external AC power. Specifically, the rectifier 210 may be implemented by a bridge full-wave rectifying circuit.

The PFC device 220 makes the voltage and current of the rectified AC power in the same phase. Specifically, the PFC device 220 may make the voltage and current of the AC power rectified by the rectifier 210 to be in phase. Then, the PFC device 220 may transform the AC voltage of which the voltage and current are made in the same phase into a DC voltage. Although it is exemplified that the PFC device 220 transforms the AC power into the DC voltage in this exemplary embodiment, a converter 230 to be described later may perform the conversion to the DC voltage.

The converter 230 may convert the DC voltage into a plurality of voltages to output the plurality of voltages through a multi-winding insulation transformer. On the other hand, the converter 230 may transform the AC power in which the voltage and current are made in the same phase. Specifically, the converter 230 may be implemented by a discrete LLC converter that is a resonant converter, and the detailed configuration of the discrete LLC converter will be described later with reference to FIG. 4.

The switching unit 240 selectively provides the transformed DC voltage to the plurality of output terminals 270, 272, 274. Specifically, the switching unit 240 may be implemented by a plurality of resonant synchronous switching devices, which will be described later with reference to FIG. 5.

The power controller 250 controls the switching unit 240 so that the feedback control is performed with respect to the plurality of driving voltage values output from the plurality of output terminals 270, 272, 274. Specifically, because the power supply 200 provides large current to the OLED panel, the voltage at an input terminal of the OLED panel may be lower than the driving voltage output from the switching unit 240. That is, the driving voltage may be dropped by the cable, and the power controller 250 may perform the feedback control with respect to the respective driving voltages of the plurality of driving powers output from the plurality of output terminals 270, 272, 274.

Then, the power controller 250 may control the converter 230 to perform the feed-forward control with respect to the driving powers output from the plurality of output terminals 270, 272, 274 based on the video signal. Here, the feed-forward control is a control method that predicts in advance the change of the control amount due to disturbance and performs the control operation corresponding to this to make a quick response. In this exemplary embodiment, the driving current for the RGB colors for the OLED panel 110 is predicted on the basis of the video signal provided to the OLED panel 110, and the plurality of driving powers supplied to the OLED panel 110 are controlled on the basis of the predicted driving current for the RGB colors.

Accordingly, the power controller 250 may predict the driving current for the RGB colors to be supplied to the OLED panel based on the luminance information of the input video signal, and control the converter 230 based on the predicted driving current for the RGB colors. Here, the luminance information includes information on the light emitting levels for the RGB colors of the OLED panel and timing information to which the light emitting levels are applied. Accordingly, the power supply 200 may output the plurality of driving powers that correspond to the luminance information for the RGB colors in the timing that corresponds to the luminance information using a lookup table which stores a plurality of driving current values that correspond to the plurality of light emitting levels of the OLED panel. This feed-forward control may be performed simultaneously with the above-described feedback control.

Although it is exemplified that the video signal itself that is provided to the OLED panel 110 is received and used in this exemplary embodiment, it is also possible to receive and use only information required during the feed-forward control (for example, luminance information or predicted driving current values) in implementation.

Figure 4:
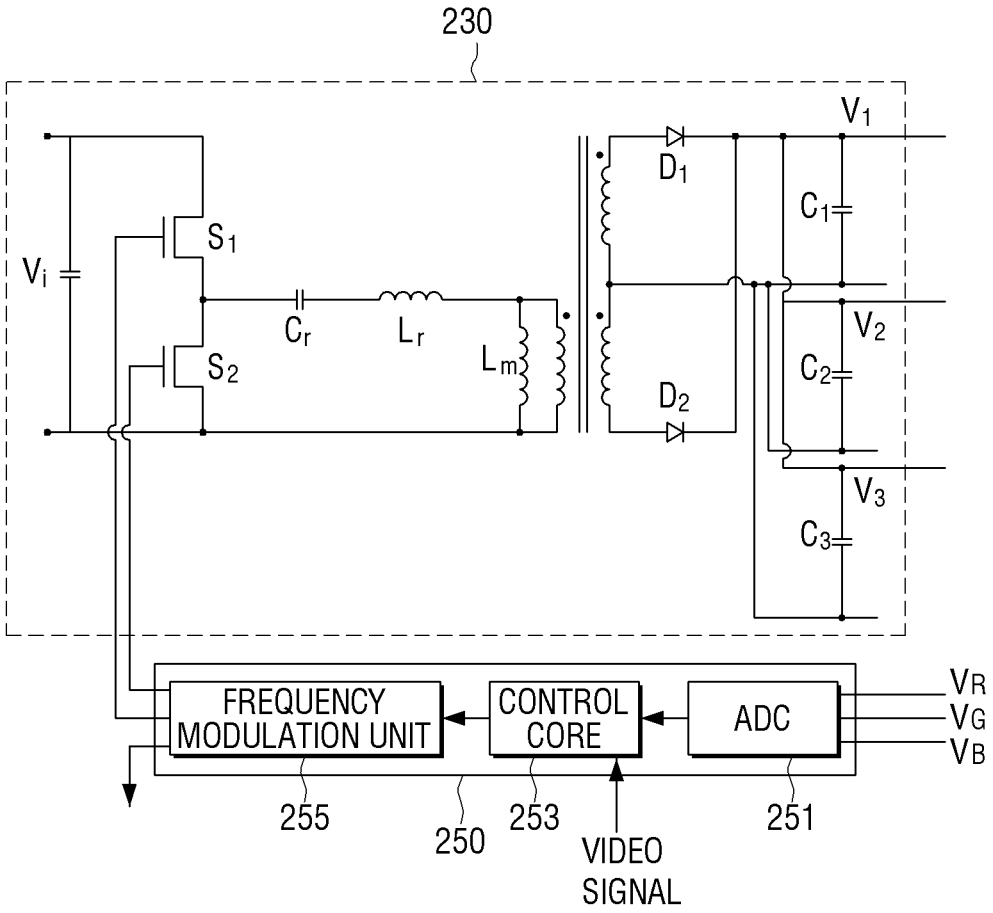
FIG. 4 is a diagram illustrating the detailed configuration of a converter and a power controller.

FIG. 4 is a diagram illustrating the detailed configuration of a converter and a power controller of FIG. 3.

Referring to FIG. 4, the converter 230 is a discrete LLC converter that is a resonant converter. Specifically, the converter 230 may be implemented by an LLC half-bridge resonant converter that uses leakage inductance as resonant inductor using a separation type transformer bobbin. Although it is exemplified that the converter 230 is implemented using the LLC half-bridge resonant converter in this exemplary embodiment, the converter 230 may be implemented in a form that uses other LLC converters.

The power controller 250 may include an analog-to-digital converter (ADC) 251, a control core 253, and a frequency modulation unit 255.

The ADC 251 may detect the plurality of driving powers. Specifically, the ADC 251 detects voltage values of the plurality of driving powers output from the switching unit 240, and may provide the detected voltage values of the plurality of driving powers to the control core 253 as digital values.

The control core 253 may perform feedback control and feed-forward control with respect to the plurality of driving powers output from the power supply 200. Specifically, the control core 253 may perform operations for the feedback control and the feed-forward control with respect to the plurality of driving powers based on the digital voltage values of the driving powers provided from the ADC 251 and the video signal provided from the video signal providing unit 120.

The frequency modulation unit 255 may modulate the control signal based on the result of the operation into a frequency signal, and may provide the modulated control signal to the converter 230 and the switching unit 240.

Figure 5:
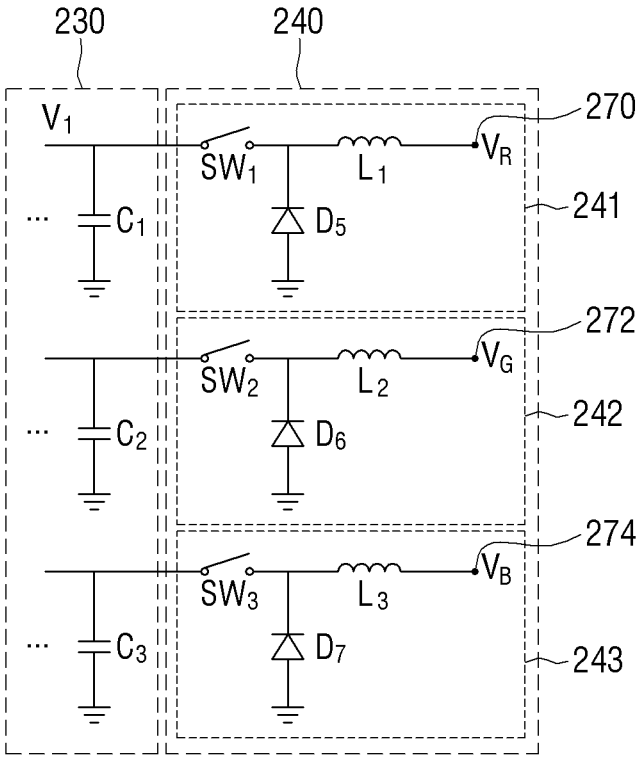
FIG. 5 is a diagram illustrating the detailed configuration of a switching unit.

FIG. 5 is a diagram illustrating the detailed configuration of a switching unit of FIG. 3.

Referring to FIG. 5, the switching unit 240 includes a plurality of resonant synchronous switching devices 241, 242, and 243.

The resonant synchronous switching devices 241, 242, and 243 selectively provide the power generated by the converter 240 to the output terminals 270, 272, 274 under the control of the power controller 250. Specifically, each of the resonant synchronous switching devices 241, 242, and 243 may include a switching element, an inductor, and a diode.

Each of the switching elements SW1, SW2, and SW3 has one end connected to an output terminal of the converter 230 and the other end commonly connected to an anode of a diode D5, D6, or D7 and one end of an inductor L1, L2, or L3.

Each of the diodes D5, D6, and D7 has an anode commonly connected to the other end of the switching element SW1, SW2, or SW3 and one end of the inductor L1, L2, or L3 and a cathode connected to ground.

Each of inductors L1, L2 and L3 has one end commonly connected to the other end of the switching element SW1, SW2, or SW3 and an anode of the diode D5, D6, or D7 and the other end connected to the output terminal 270, 272, or 274 that output the driving power.

As described above, the switching unit 240 according to this exemplary embodiment can output the plurality of driving powers without employing a separate multi-channel buck converter because that it uses the plurality of resonant synchronous switching devices. Further, because the switching unit 240 does not use the multi-channel buck converter, the volume of the power supply device can be reduced and thus the manufacturing cost can be saved.

Figure 6:
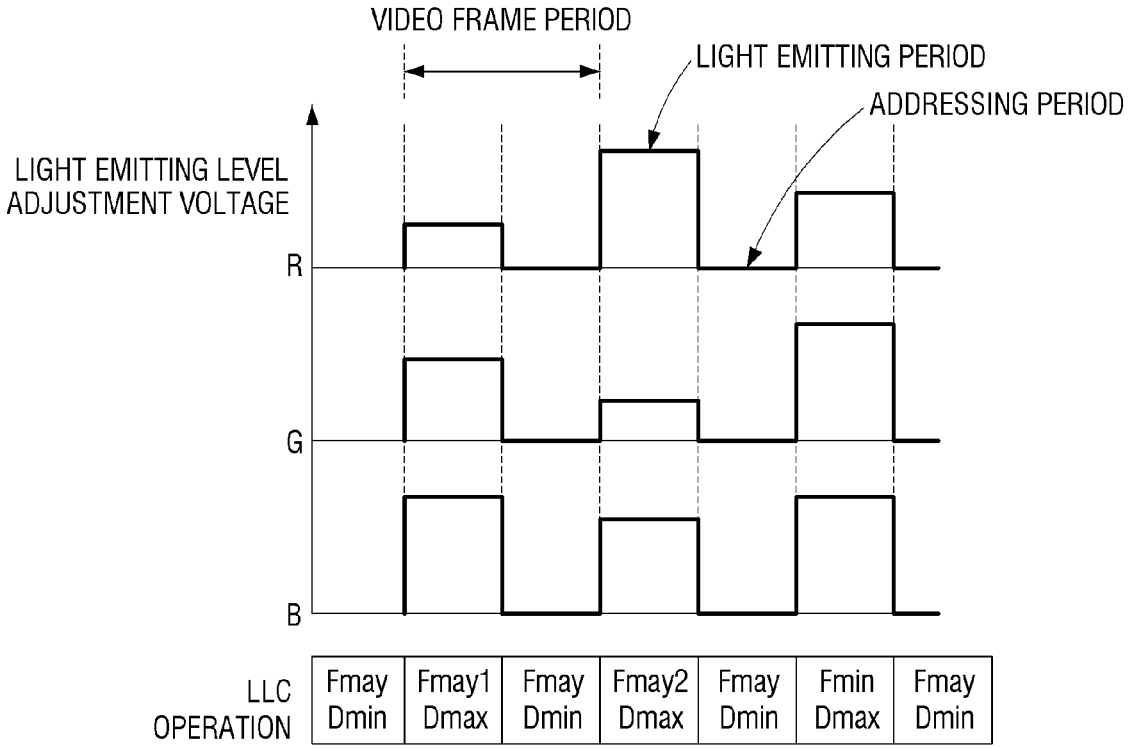
FIG. 6 is a diagram illustrating an example of a video signal.

FIG. 6 is a diagram illustrating an example of a video signal.

Referring to FIG. 6, the video signal has a preset video frame period, and the video frame period has a light emitting period in which the OLED panel emits light and an addressing period in which light emission is not performed. Further, different OLED light emitting level adjustment voltage values are provided for the respective light emitting periods.

Accordingly, in this exemplary embodiment, the feed-forward control is performed using OLED light emitting level adjustment voltage value information in the light emitting period and information on the light emitting period to which the corresponding adjustment voltage value is applied (that is, timing information). Specifically, the converter 230 may be controlled so that, in the first frame, the driving current to be provided to the OLED panel is predicted on the basis of an average light emitting level voltage required for the RGB color channels, and the DC voltage corresponding to the predicted driving current is generated.

Figure 7:
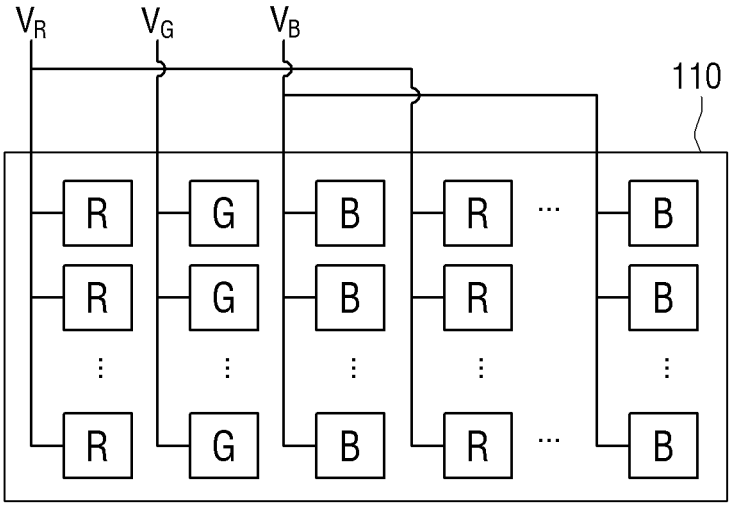
FIG. 7 is a diagram illustrating the configuration of an OLED panel.

FIG. 7 is a diagram illustrating the configuration of an OLED panel of FIGS. 1 and 2.

Referring to FIG. 7, the OLED panel includes a plurality of pixels which are classified into a plurality of pixel groups for the RGB colors and are arranged in a matrix form. Here, the plurality of pixel groups may include an R pixel group, a G pixel group, and a B pixel group. The respective pixel groups receive different driving voltage values and/or different current values.

Although it is exemplified that the pixels are classified into three pixel groups in this exemplary embodiment, it is also possible to classify the pixels of the OLED panel into two or four or more pixel groups. For example, in the case where the OLED panel is classified into RGBW (red, green, blue, white) pixel groups, the power supply 200 may be implemented to provide four driving powers to the OLED panel.

Figure 8:
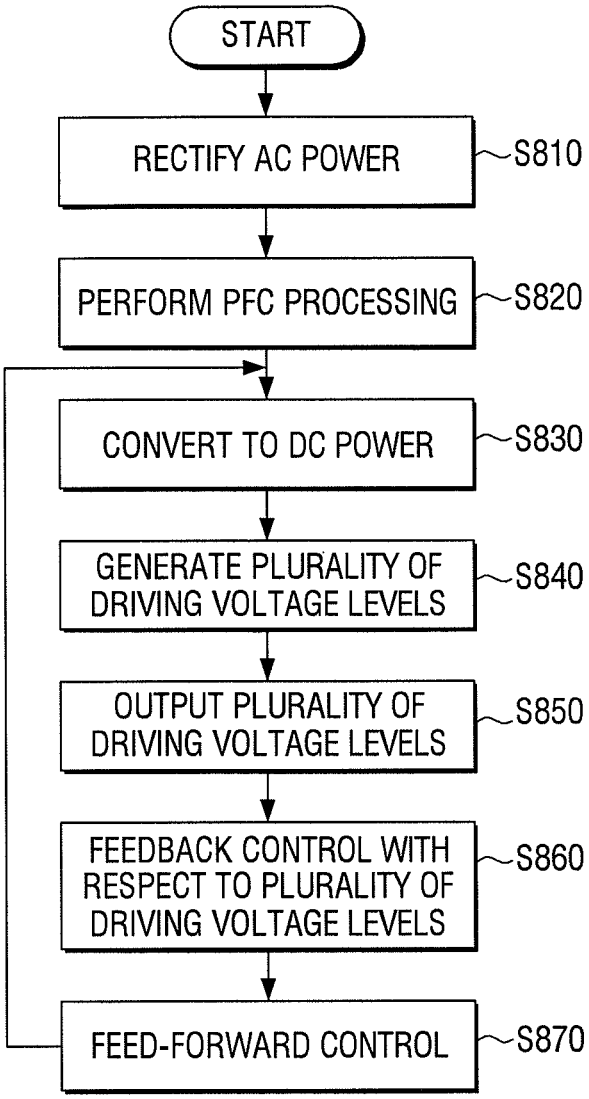
FIG. 8 is a flowchart illustrating a power supply method according to an exemplary embodiment.

FIG. 8 is a flowchart illustrating a power supply method according to an exemplary embodiment.

Referring to FIG. 8, an external AC power is rectified (S810). Specifically, the external AC power may be rectified using a bridge full-wave rectifying circuit.

Then, a voltage and current of the rectified AC power are made to be in the same phase (S820). Specifically, the voltage and current of the rectified AC power may be made in the same phase using the PFC circuit.

Then, the AC power of which the voltage and current have been made in the same phase is transformed into a DC voltage of a preset level (S830). Specifically, the AC power may be converted into the DC voltage of the preset level using the discrete LLC converter.

Then, the DC voltage of the preset level is converted into a plurality of driving power levels (S840). Specifically, the transformed DC voltage may be converted into a plurality of driving power levels for the RGB colors.

Then, the plurality of converted driving power levels may be output to the OLED panel (S850).

Then, a feedback control may be performed with respect to the plurality of converted driving powers (S860). On the other hand, driving current values for the RGB colors supplied to the OLED panel may be predicted based on luminance information of the input video signal and a feed-forward control is performed based on the predicted driving current values (S870).

Accordingly, the power supply method according to this exemplary embodiment supplies separate driving powers for RGB colors to the OLED panel, performs separate feedback controls with respect to the respective driving powers, and adaptively provides driving powers to the OLED panel. Accordingly, the power consumption of the display apparatus 100 can be reduced. The power supply method illustrated in FIG. 8 may be executed by the display apparatus having the configuration illustrated in FIG. 1 or the power supply device having the configuration illustrated in FIG. 3. Further, the power supply method may be executed by other display apparatuses or power supply devices having other configurations.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A display apparatus comprising:

an Organic Light Emitting Diode (OLED) panel which receives an input of a video signal and a plurality of driving power levels for red, green, and blue (RGB) colors and displays an image;

a video signal providing unit which provides the video signal to the OLED panel; and a power supply which supplies the plurality of driving power levels to the OLED panel and performs individual feedback control for each of the plurality of driving power levels, wherein the power supply comprises:

a converter configured to convert an input DC voltage into a plurality of voltage levels and output the plurality of voltage levels from respective first output terminals, switching devices connected to operate in parallel to one another and each comprising a respective switching element having one end connected to the respective first output terminal of the converter, and second output terminals each connected to an other end of the respective switching element and configured to output one of the plurality of voltage levels in response to the respective switching element being closed, and wherein each of the switching devices further comprises:

an inductor having a first end connected to the other end of the respective switching element and a second end connected to one of the second output terminals; and a diode having an anode connected to the other end of the respective switching element and the first end of the inductor and a cathode connected to a ground terminal.

2. The display apparatus as claimed in claim 1, wherein the OLED panel includes a plurality of pixels that are classified into a plurality of pixel groups for the RGB colors and arranged in a matrix, and the plurality of pixel groups receives separate driving power values.

3. The display apparatus as claimed in claim 1, wherein the power supply further comprises:

a rectifier which rectifies an external AC power;

a power factor correction (PFC) device which makes voltage and current of the rectified AC power to be in the same phase and transforms the AC voltage into the input DC voltage; and a power controller which controls the switching elements to perform the feedback control with respect to the plurality of voltage levels output from the second output terminals.

4. The display apparatus as claimed in claim 3, wherein the converter is a discrete LLC converter.

5. The display apparatus as claimed in claim 1, wherein the power supply performs a feed-forward control with respect to the plurality of driving power levels based on the video signal.

6. The display apparatus as claimed in claim 5, wherein the power supply predicts driving current values for the RGB colors to be supplied to the OLED panel based on luminance information of the video signal, and performs the feed-forward control with respect to the plurality of driving power levels based on the predicted driving current values.

7. The display apparatus as claimed in claim 6, wherein the luminance information includes information on light emitting levels for the RGB colors of the OLED panel and timing information to which the light emitting levels are applied.

8. A power supply device providing a plurality of driving power levels for red, green, and blue (RGB) colors to an Organic Light Emitting Diode (OLED) panel, the power supply device comprising:

a rectifier configured to rectify an external AC power;

a power factor correction (PFC) device configured to make voltage and current of the rectified AC power to be in the same phase and transform the AC voltage into DC voltage;

a converter configured to convert the DC voltage into a plurality of voltage levels and output the plurality of voltage levels from respective first output terminals;

switching devices connected to operate in parallel to one another and each including a respective switching element having one end connected to the respective first output terminal of the converter to receive one of the plurality of voltage levels;

second output terminals each connected to an other end of the respective switching element and configured to output the one of the plurality of voltage levels in response to the respective switching element being closed; and a power controller configured to control the switching elements to perform a feedback control with respect to the plurality of voltage levels output from the second output terminals, wherein each of the switching devices further comprises:

an inductor having a first end connected to the other end of the respective switching element and a second end connected to one of the second output terminals; and a diode having an anode connected to the other end of the respective switching element and the first end of the inductor and a cathode connected to a ground terminal.

9. The power supply device as claimed in claim 8, wherein the converter is a discrete LLC converter.

10. The power supply device as claimed in claim 8, wherein the power controller performs a feed-forward control with respect to the plurality of driving power levels based on a video signal.

11. The power supply device as claimed in claim 10, wherein the power controller predicts driving current values for the RGB colors to be supplied to the OLED panel based on luminance information of the video signal, and performs the feed-forward control with respect to the plurality of driving power levels based on the predicted driving current values.

12. The power supply device as claimed in claim 11, wherein the luminance information includes information on light emitting levels for the RGB colors of the OLED panel and timing information to which the light emitting levels are applied.

13. A power supply method of a power supply device providing a plurality of driving power levels for red, green, and blue (RGB) colors to an Organic Light Emitting Diode (OLED) panel, the method comprising:

rectifying an external AC power;

making voltage and current of the rectified AC power to be in the same phase;

transforming the AC power of which the voltage and current have been made to be in the same phase into DC voltage of a preset level;

converting the DC voltage of the preset level into the plurality of driving power levels for the RGB colors and outputting the plurality of driving power levels from respective first output terminals of a converter;

closing switching elements connected to operate in parallel to one another and each having one end connected to the respective first output terminal of the converter and an other end connected to an anode of a diode having a cathode connected to a ground terminal;

outputting the plurality of converted driving power levels to the OLED panel from second output terminals each connected to the other end of a respective switching element via an inductor, in response to the respective switching element being closed; and performing a feedback control with respect the plurality of converted driving power levels.

14. The power supply method as claimed in claim 13, wherein the converting comprises converting the DC voltage into the plurality of driving power levels having different voltage levels for the RGB colors.

15. The power supply method as claimed in claim 13, further comprising performing a feed-forward control with respect to the plurality of driving power levels based on the video signal.

16. The power supply method as claimed in claim 13, wherein the performing the feed-forward control comprises predicting driving current values for the RGB colors to be supplied to the OLED panel based on luminance information of the video signal; and performing the feed-forward control with respect to the plurality of driving power levels based on the predicted driving current values.

17. The power supply method as claimed in claim 16, wherein the luminance information includes information on light emitting levels for the RGB colors of the OLED panel and timing information to which the light emitting levels are applied.

18. The display apparatus as claimed in claim 1, wherein the converter is configured to output the plurality of voltage levels different from one another from the respective first output terminals, for each of the red, blue, and green colors of the OLED panel, and each respective second output terminal is connected to corresponding one of the red, blue, and green colors of the OLED panel, to provide a corresponding one of the plurality of voltage levels from the converter, in response to the respective switching element being closed.

19. The display apparatus as claimed in claim 1, wherein the converter comprises a discrete LLC converter comprising a half-bridge.

* * * * *